US007169016B2

(12) United States Patent
Barada et al.

(10) Patent No.: US 7,169,016 B2
(45) Date of Patent: Jan. 30, 2007

(54) CHEMICAL MECHANICAL POLISHING END POINT DETECTION APPARATUS AND METHOD

(75) Inventors: Andrew H. Barada, Portola Valley, CA (US); Takehiko Ueda, Kanagawa-ken (JP)

(73) Assignee: Nikon Corporation (JP)

( * ) Notice: Subject to any disclaimer, the term of this patent is extended or adjusted under 35 U.S.C. 154(b) by 0 days.

(21) Appl. No.: 11/275,715

(22) Filed: Jan. 25, 2006

(65) Prior Publication Data

US 2006/0258263 A1 Nov. 16, 2006

Related U.S. Application Data

(60) Provisional application No. 60/594,829, filed on May 10, 2005.

(51) Int. Cl.
*B24B 49/12* (2006.01)

(52) U.S. Cl. ..... 451/6; 451/5

(58) Field of Classification Search ..... 451/6, 451/5, 8, 41, 287, 288, 289
See application file for complete search history.

(56) References Cited

U.S. PATENT DOCUMENTS

| | | | | |
|---|---|---|---|---|
| 5,643,046 | A * | 7/1997 | Katakabe et al. | 451/6 |
| 5,838,448 | A | 11/1998 | Aiyer et al. | |
| 6,146,242 | A * | 11/2000 | Treur et al. | 451/6 |
| 6,168,683 | B1 | 1/2001 | Cesna | |
| 6,248,000 | B1 | 6/2001 | Aiyer | |
| 6,261,152 | B1 | 7/2001 | Aiyer | |
| 6,485,354 | B1 * | 11/2002 | Wolf | 451/6 |
| 6,966,816 | B2 * | 11/2005 | Swedek et al. | 451/5 |
| 2003/0020009 | A1 | 1/2003 | Sugiyama et al. | |

FOREIGN PATENT DOCUMENTS

| | | | | |
|---|---|---|---|---|
| JP | 0134162 | * | 6/1988 | 451/6 |
| JP | 06252113 | * | 9/1994 | 451/41 |
| JP | 2002-178257 | | 6/2002 | |
| WO | WO95/18353 | | 7/1995 | |

OTHER PUBLICATIONS http:/www.verityinst.com.html, Verity Instruments, Inc. Company Profile, Press Release, and Products.
Verity Instruments, Inc., Applications Information.

* cited by examiner

*Primary Examiner*—Robert A. Rose
(74) *Attorney, Agent, or Firm*—Aka Chan LLP

(57) ABSTRACT

Methods and apparatus for substantially continuously measuring the surface of a wafer during a polishing process are disclosed. According to one aspect of the present invention, an apparatus includes a wafer support table that supports a wafer, a polishing pad that polishes a surface of the wafer, and a polishing pad structure that rotates the polishing pad over the surface of the wafer. The apparatus also includes a measuring device which is capable of continuously measuring the surface of the wafer during polishing of the surface of the wafer.

2 Claims, 14 Drawing Sheets

CHEMICAL MECHANICAL POLISHING END POINT DETECTION APPARATUS AND METHOD

CROSS-REFERENCE TO RELATED APPLICATION

This patent application claims priority of U.S. Provisional Patent Application No. 60/594,829, filed May 10, 2005, which is incorporated herein by reference in its entirety.

BACKGROUND OF THE INVENTION

1. Field of Invention

The present invention relates generally to chemical mechanical polishing systems. More particularly, the present invention relates to a sensor arrangement that allows for an efficient and accurate determination to be made regarding when a chemical mechanical polishing procedure is completed.

2. Description of the Related Art

Ensuring the planarity of the surface of a semiconductor wafer is crucial if the integrity of photolithography processes performed on the semiconductor wafer is to be maintained at a high level. That is, it is important that the surface of a semiconductor wafer be planar in order to meet the requirements of photolithography processes. By way of example, the planarity of the surface of a semiconductor wafer is critical to photolithography processes as the depth of focus of photolithography processes may not be adequate for surfaces which do not have a consistent height.

A chemical mechanical polishing (CMP) process is often used to planarize the surface of a semiconductor wafer. CMP is effective in improving the global planarity of the surface of a semiconductor wafer. The assurance of planarity is crucial to the lithography process as the depth of focus of the lithography process is often inadequate for surfaces which do not have a consistent height.

CMP processes generally utilize a polishing pad made from a synthetic fabric and a polishing slurry which includes pH-balanced chemicals, such as sodium hydroxide, and silicon dioxide particles. A semiconductor wafer is mounted on a polishing fixture such that the wafer is pressed against the polishing pad under pressure. The fixture then rotates and translates the wafer relative to the polishing pad. The polishing slurry assists in the actual polishing of the wafer. Abrasive forces are created by the motion of a wafer against a polishing pad and cause material to be abraded away from the surface of the wafer. While the pH of the polishing slurry controls chemical reactions such as the oxidation of the chemicals which comprise an insulating layer of the wafer, the size of the silicon dioxide particles in the polishing slurry controls the physical abrasion of surface of the wafer. The polishing of the wafer is accomplished when abrasive forces enable the silicon dioxide particles to abrade away the oxidized chemicals. Often, different layers of the wafer may be thinned to a desired thickness through CMP.

In general, it is desirable to detect when the surface of a wafer has been polished to a desired level, e.g., when the surface of a wafer is planar. To determine whether the wafer surface has reached a desired level of planarity or, more generally, to determine when a polishing endpoint is reached, the wafer may be removed from an overall CMP apparatus and inspected. With such an approach, if the wafer does not meet desired specifications, it may be necessary to reload the wafer onto the overall CMP apparatus and continue polishing the wafer. Such an approach, while often effective, is inefficient in that it is both time consuming and relatively labor-intensive. In addition, since such an approach is not in-situ, there may be occasions in which excess material is removed from the surface of a wafer before the wafer is inspected. When excess material is removed, the wafer may be deemed unusable.

To determine when a desired film thickness is reached or, more generally, to determine when a polishing endpoint has been reached, some CMP systems utilize windows embedded in a polishing pad to allow the surface of a wafer to effectively be viewed in-situ. With reference to FIGS. 1A and 1B, one conventional CMP system will be described. FIG. 1A is a diagrammatic top-view representation of a CMP polishing system 100, and FIG. 1B is a diagrammatic side-view representation of CMP polishing system 100. A CMP polishing system 100 includes a polishing pad or platen 104 attached to an actuator assembly (not shown) at an annulus 108. As polishing pad 104 rotates about a z-direction 110 while making contact with a wafer 114 that is being polished. Wafer 114 also rotates about x-direction 110.

A window 116 that is embedded in polishing pad 104 effectively moves with polishing pad 104 and, when wafer 114 is positioned directly below window 116, a sensing system which "views" wafer 114 through window 116 may effectively sense the status of a polishing process in-situ. Such a sensing system may utilize a laser interferometer or an electrical eddy current sensor to measure the thickness of a layer of wafer 114, or to determine whether the surface of wafer 114 is suitably planar. That is, a sensing system (not shown) effectively views wafer 114 through window 116 and allows a determination to be made as to whether a polishing endpoint has been reached.

While the use of window 116 in conjunction with a sensing system (not shown) is effective in allowing a polishing endpoint to be detected in-situ, the alignment of window 116 often needs to be readjusted, as contact of window 116 with wafer 114 and abrasive forces between window 116 and wafer 114 may adversely affect the alignment of window 116. Additionally, window 116 may need to be replaced or changed out fairly often, as window 116 is effectively polished by a CMP process. When window 116 is polished, the transparency of window 116 may be adversely affected, thereby affective the performance of a sensing system (not shown) that utilizes window 116. Realigning and replacing window 116 within polishing pad 104 may be a time-consuming process. Further, each time window 116 needs to be realigned or replaced, polishing pad 104 must effectively be taken off-line and not used for polishing purposes until after window 116 is sufficiently realigned or replaced.

In addition, window 116 transits on and off of wafer 114 during a CMP process. Hence, wafer 114 may not be viewed during all portions of a polishing process. The inability to view wafer 114 during all portions of a polishing process may result in an endpoint not being detected until the endpoint has been passed. In other words, if wafer 114 is not viewed throughout the polishing process, there is a possibility that an endpoint may be reached during the time in which window 116 is not positioned over wafer 114.

Therefore, what is needed is a method and an apparatus that allows a polishing endpoint to be efficiently detected. That is, what is desired is a system that enables a polishing endpoint to be efficiently detected in-situ by monitoring a wafer surface throughout a polishing process.

SUMMARY OF THE INVENTION

The present invention relates to chemical mechanical polishing (CMP) apparatus which is capable of substantially continuously measuring the surface of a wafer during a polishing process. According to one aspect of the present invention, an apparatus includes a wafer support table that supports a wafer, a polishing pad that polishes a surface of the wafer, and a polishing pad structure that rotates the polishing pad over the surface of the wafer. The apparatus also includes a measuring device which is capable of continuously measuring the surface of the wafer during polishing of the surface of the wafer.

In one embodiment, the measuring device is positioned in a recess or an opening formed in the polishing pad. In such an embodiment, the measurement device may be a fiberoptic device that is configured to optically measure the surface of the wafer during polishing, or the measuring device may be an eddy current sensor.

A polishing pad arrangement that includes an annulus in which a fiberoptic is embedded may utilize a segmented optical fiber path to accommodate translational and rotational motions of the polishing pad arrangement. The segmented optical fiber path may include a fixed fiberoptic portion and a rotating fiberoptic portion which, when aligned such that an optical signal may pass there between, enables data to be acquired from a surface in contact with the rotating fiberoptic portion. Such data, e.g., data that is used to determine a depth associated with the surface, may be obtained in-situ during a polishing process over substantially the entire surface, as the rotating fiberoptic portion is substantially always in contact with the surface during the polishing process.

According to another aspect of the present invention, a method of identifying an endpoint of a CMP process performed on a polishing surface includes polishing the polishing surface using a polishing pad assembly, and providing an optical signal through an optical signal path arrangement. The optical signal path arrangement includes a fixed portion and a moving portion. The moving portion is at least partially contained by an annulus of the polishing pad assembly. The method also includes receiving the reflected optical signal through the optical signal path arrangement when the fixed portion and the moving portion are aligned to allow the reflected optical signal to pass through the moving portion to the fixed portion, and processing the reflected optical signal to determine if the endpoint has been reached. Processing the reflected optical signal includes determining a depth associated with the polishing surface.

In one embodiment, the optical signal is provided by a light emitting diode (LED) through a first path of the optical signal path arrangement and the reflected optical signal is received by an annular fiberoptic ring of the fixed portion through a second path of the optical signal path. In another embodiment, the reflected optical signal is reflected off of the polishing surface and off of a mirror arrangement which includes a conical mirror and a concave ring-shaped mirror into the fixed portion.

According to still another aspect of the present invention, a method of identifying an endpoint of a CMP process includes rotating a polishing pad arrangement over the polishing surface of a wafer, and continuously measuring the polishing surface when the polishing pad arrangement is rotating over the polishing surface. In one embodiment, continuously measuring the polishing surface involves continuously measuring a plurality of locations on the polishing surface substantially simultaneously.

These and other advantages of the present invention will become apparent upon reading the following detailed descriptions and studying the various figures of the drawings.

BRIEF DESCRIPTION OF THE DRAWINGS

The invention may best be understood by reference to the following description taken in conjunction with the accompanying drawings in which.

DETAILED DESCRIPTION

The ability to detect an endpoint of a chemical mechanical polishing (CMP) process in-situ reduces the likelihood that too much material or too little material is removed from the surface of a wafer. Many conventional systems use windows in polishing pads to facilitate the in-situ detection of endpoints. However, the use of windows generally requires a relatively high amount of maintenance, and providing illumination through the windows may require a relatively large amount of power.

By providing fiberoptics to an annulus of a polishing pad arrangement, measurements associated with a wafer surface may be obtained during substantially all portions of a polishing process, and a mapping may be obtained of substantially the entire wafer surface. Further, when fiberoptics are provided in the annulus of a polishing pad arrangement, the alignment of the fiberoptics relative to the polishing pad is relatively easy to maintain.

Fiberoptics may be provided as a substantially segmented optical fiber path. Such a path may include a fixed portion as well as a rotating and translating portion. The rotating and translating portions are arranged to move with a polishing head and, hence, a polishing pad, while the fixed portions remain substantially stationary within a CMP apparatus. The interface between the rotating portion and the fixed portion is arranged such that when the rotating portion and the fixed portion are aligned, light may pass between the two portions. In one embodiment, an optical signal may be transmitted from a fixed or stationary sensor arrangement into a rotating polishing head assembly, then reflected from a wafer surface back through the polishing head assembly to the fixed sensor arrangement where the reflected signal may then effectively be processed to determine a depth associated with the wafer surface.

Figure 1A:
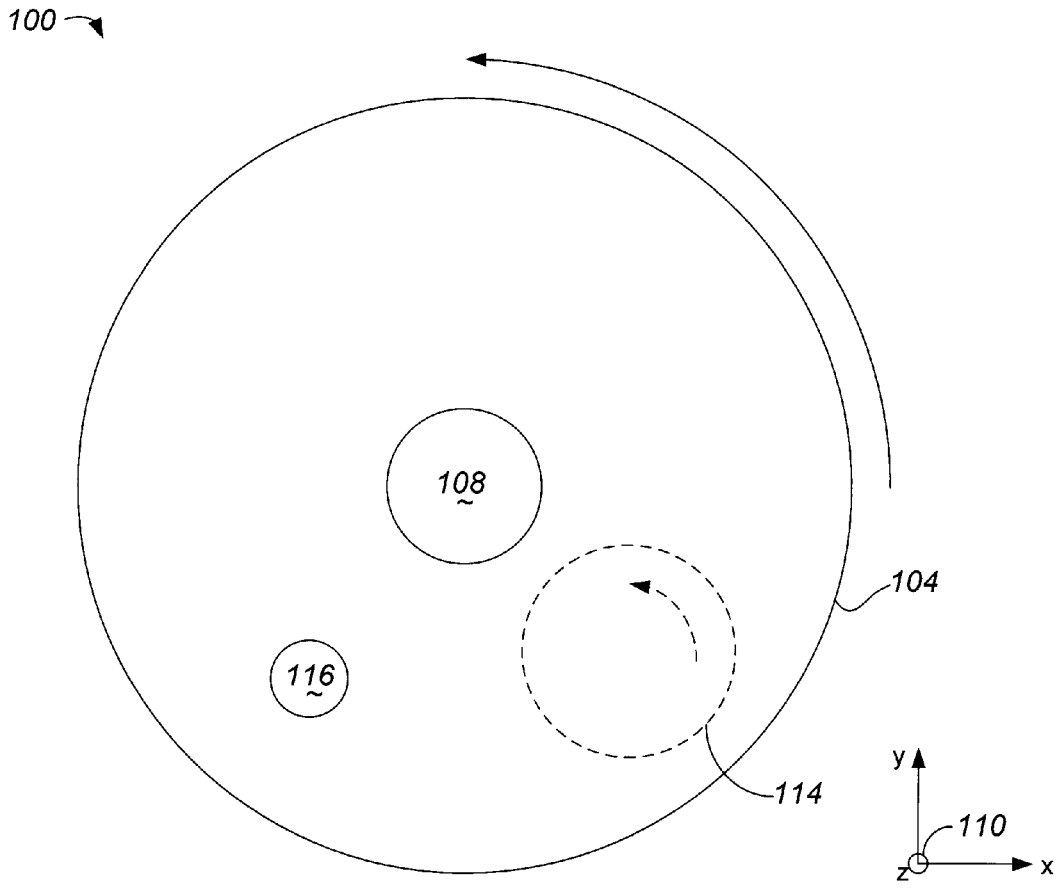
FIG. 1A PRIOR ART
FIG. 1A is a diagrammatic top-view representation of a chemical mechanical polishing (CMP) system.
Figure 1B:
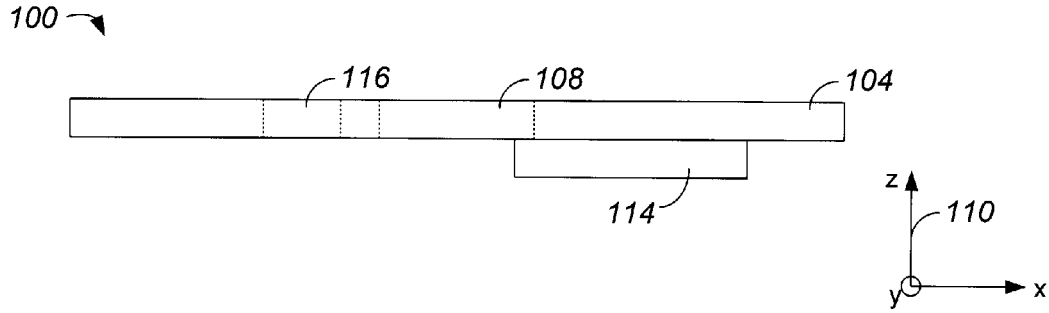
FIG. 1B PRIOR ART
FIG. 1B is a diagrammatic side-view representation of a CMP system, i.e., CMP system 100 of FIG. 1A.
Figure 2A:
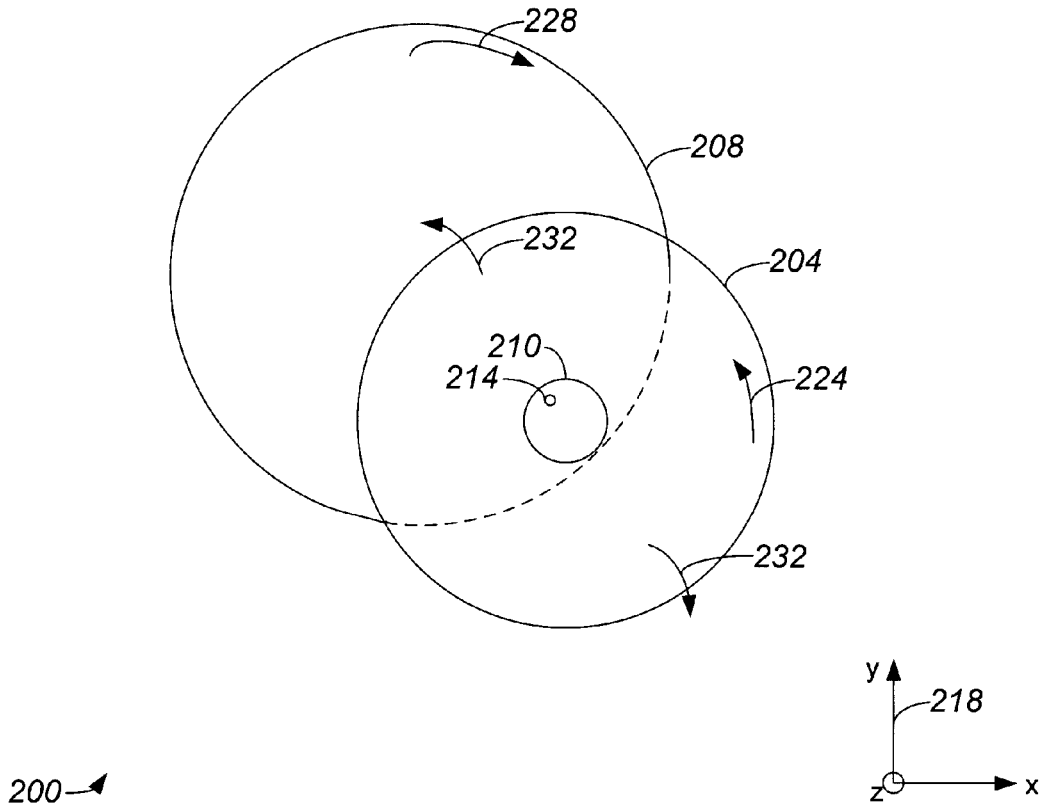
FIG. 2A is a diagrammatic top-view representation of a CMP system in accordance with an embodiment of the present invention.
Figure 2B:
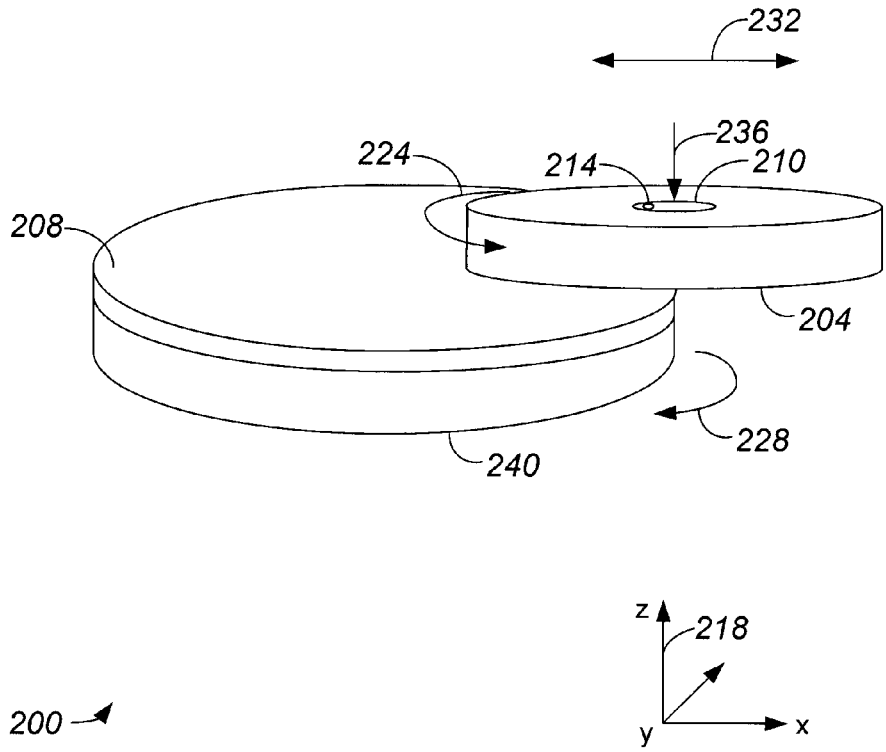
FIG. 2B is a diagrammatic perspective representation of a CMP system, i.e., CMP system 200 of FIG. 2A, in accordance with an embodiment of the present invention.

FIG. 2A is a diagrammatic top-view representation of a CMP system in accordance with an embodiment of the present invention. A CMP system 200 includes a polishing pad or platen 204 that is arranged to polish a wafer 208. Both polishing pad 204 and wafer 208 are arranged to rotate about a z-direction 218, as indicated by arrow 224 and arrow 228, respectively. Wafer 208 is supported on a supporting table 204 which allows wafer 208 to rotate, as shown in FIG. 2B. Polishing pad 204 is further arranged to oscillate, as indicated at 232, such that polishing pad 204 moves on and off of wafer 208.

An annulus 210 associated with polishing pad 204 is arranged to be supported by a support plate (not shown) of an overall CMP apparatus. An opening 214 within annulus is arranged to support fiberoptics that transmits an optical signal onto wafer 208 and receives the reflected optical signal. The fiberoptics are processed by a processing arrangement (not shown) of the overall CMP apparatus to detect a polishing endpoint, i.e., the fiberoptics are used to provide data acquisition functionality that allows a polishing endpoint to be detected. Annulus 210 also includes an opening (not shown) through which slurry is provided, as indicated by arrow 236 of FIG. 2B.

Figure 3A:
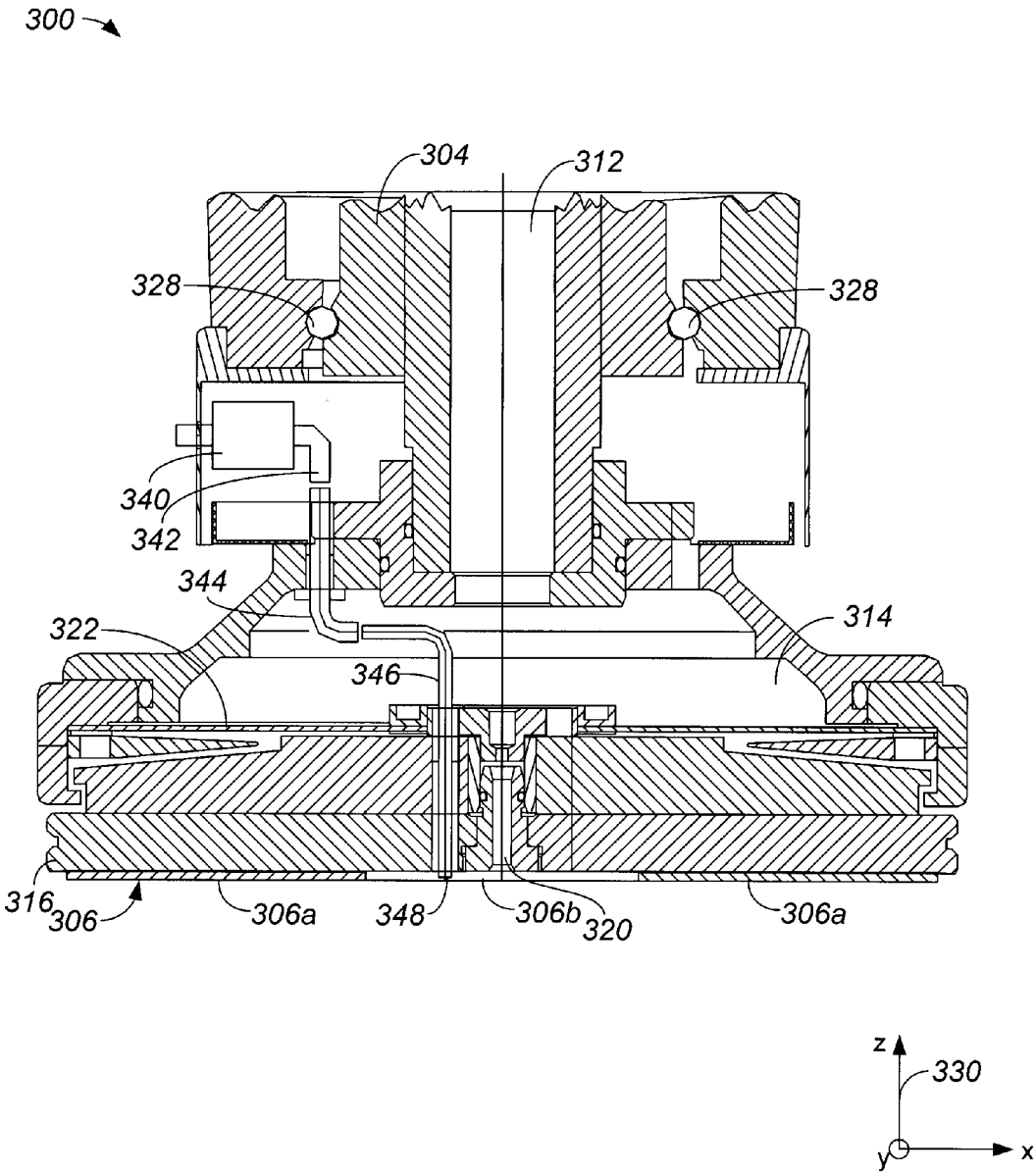
FIG. 3A is a diagrammatic, cross-sectional side-view representation of a CMP apparatus which includes a fiberoptic endpoint detector in accordance with an embodiment of the present invention.
Figure 3B:
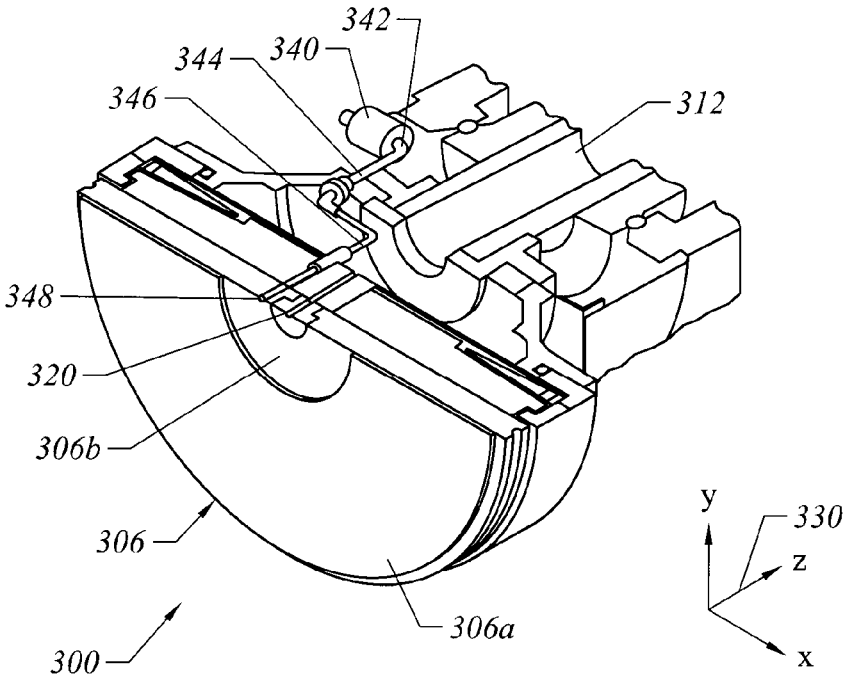
FIG. 3B is an isometric representation of a portion of a CMP apparatus, i.e., CMP apparatus 300 of FIG. 3A, in accordance with an embodiment of the present invention.

With reference to FIGS. 3A and 3B, an overall CMP apparatus that includes a polishing pad that supports fiberoptics will be described. FIG. 3A is a diagrammatic, cross-sectional side-view representation of a CMP apparatus which includes a fiberoptic endpoint detector in accordance with an embodiment of the present invention, while FIG. 3B is an isometric representation of a portion of a CMP apparatus, i.e., CMP apparatus 300 of FIG. 3A, in accordance with an embodiment of the present invention. A CMP apparatus 300 includes a polishing head 304 that is arranged to support a polishing pad arrangement 306 that includes an annulus 306*b* and a polishing pad 306*a*. A chamber 312 in polishing head 304 is coupled to a pressure room 314 and is arranged to cooperate with a diaphragm 322 provide pressurized air that holds polishing pad 306*a* against a pad plate 316. A slurry supply apparatus (not shown) may also be provided through chamber such that slurry may be dispensed through a slurry feedthrough 320. A bearing 328 is arranged to enable rotation of pad plate 316 and polishing pad arrangement 306 about a z-direction 330.

In the described embodiment, a segmented optical fiber path allows polishing head 304 to rotate and to translate while an endpoint detector sensor and sensor optics remain substantially fixed. It should be appreciated, however, that in lieu of a segmented optical fiber path a solid optical fiber path that is coiled to allow for movement of polishing head 304. An optical fiber path includes an endpoint detection sensor unit 340 that is substantially fixed to CMP apparatus 300 and does not move when polishing head 304 moves. Endpoint detection sensor unit 340 may include a capacitance sensor, in one embodiment. Alternatively, endpoint detection sensor unit 340 may include an eddy current sensor that includes a coil and causes eddy currents, which affect the inductive reactance of the coil, to be induced by a polishing surface.

Sensor optics 342, which are arranged to effectively provide a source of light and to detect reflected light, are also fixed on CMP apparatus 300. A first fiberoptic component 344 is arranged to be aligned with sensor optics 342, and is arranged to translate in z-direction 330 when polishing head 304 and, hence, polishing pad arrangement 306 translates in z-direction 330. A second fiberoptic component 346 is arranged to translate and to rotate when polishing head 304 translates and rotates. When second fiberoptic component 346 is lined up with first fiberoptic component 344, data acquisition may be performed, e.g., sensor optics 342 may send and detect light. A rotating endpoint detector 348, which is coupled to second fiberoptic component 346, is arranged to extend through annulus 306*b* such that when polishing pad 306*a* is in contact with a wafer (not shown), rotating endpoint detector 348 is substantially at a top surface of the wafer.

Figure 4A:
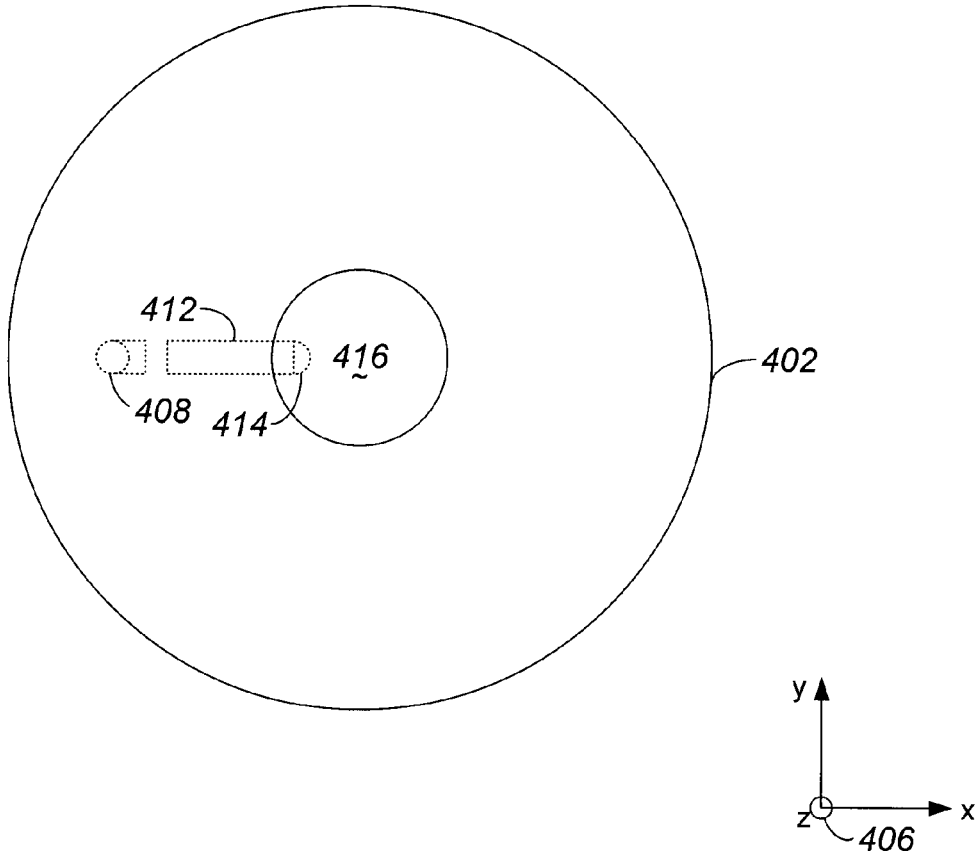
FIG. 4A is a diagrammatic top view representation of a polishing pad arrangement as shown in relation with optical components that are aligned to permit data acquisition in accordance with an embodiment of the present invention.

When first fiberoptic component 344 and second fiberoptic component 346 are aligned, an optical signal may be transmitted from sensor optics 342 to rotating endpoint 348. FIG. 4A is a diagrammatic top view representation of a polishing pad arrangement as shown in relation with optical components that are aligned to permit data acquisition in accordance with an embodiment of the present invention. When a polishing pad arrangement 402 and, hence, a polishing head (not shown) of a CMP apparatus rotates about a z-direction 406, a rotating fiberoptic portion 412 with a rotating endpoint detector 414 that is positioned in an annulus 416 of polishing pad arrangement 402 rotates with polishing pad arrangement 402. Rotating fiberoptic portion 412 may be second fiberoptic component 346 of FIGS. 3A and 3B. When rotating fiberoptic portion 412 is lined up with a fixed optical sensor pickup 408, which may correspond to sensor optics 342 of FIGS. 3A and 3B, an optical signal may be sent through rotating fiberoptic portion 412 and reflected back to fixed optical sensor pickup 408.

Figure 4B:
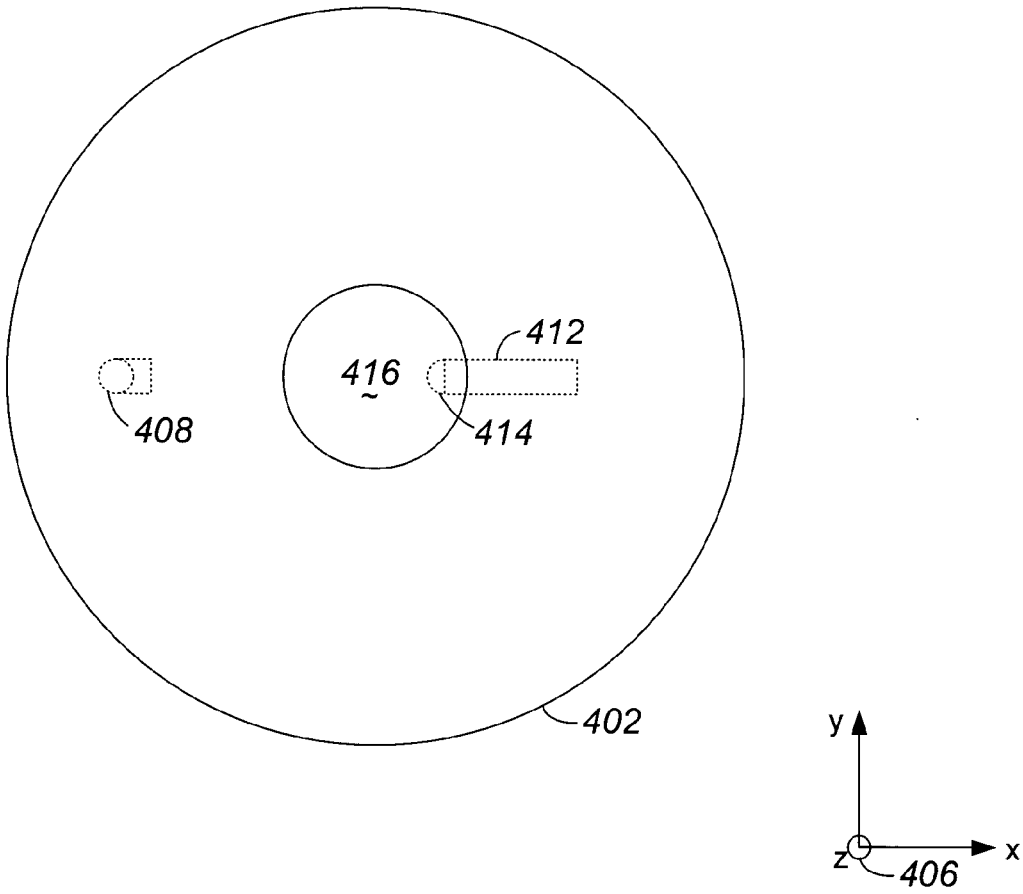
FIG. 4B is a diagrammatic top view representation of a polishing pad arrangement, i.e., polishing pad arrangement 402 of FIG. 4A, as shown in relation with optical components that are not aligned to permit data acquisition in accordance with an embodiment of the present invention.

Because polishing pad arrangement 402 rotates while fixed optical sensor pickup 408 does not, rotating fiberoptic portion 412 is not always aligned with fixed optical sensor pickup 408 such that data may be acquired. By way of example, as shown in FIG. 4B, when rotating fiberoptic portion 412 is not aligned with fixed optical sensor pickup 408, there is no path through which an optical signal may be sent and reflected back to fixed optical sensor pickup 408. That is, there is not complete optical fiber path unless rotating fiberoptic portion 412 is in line with fixed optical sensor pickup 408 as shown in FIG. 4A.

Figure 4C:
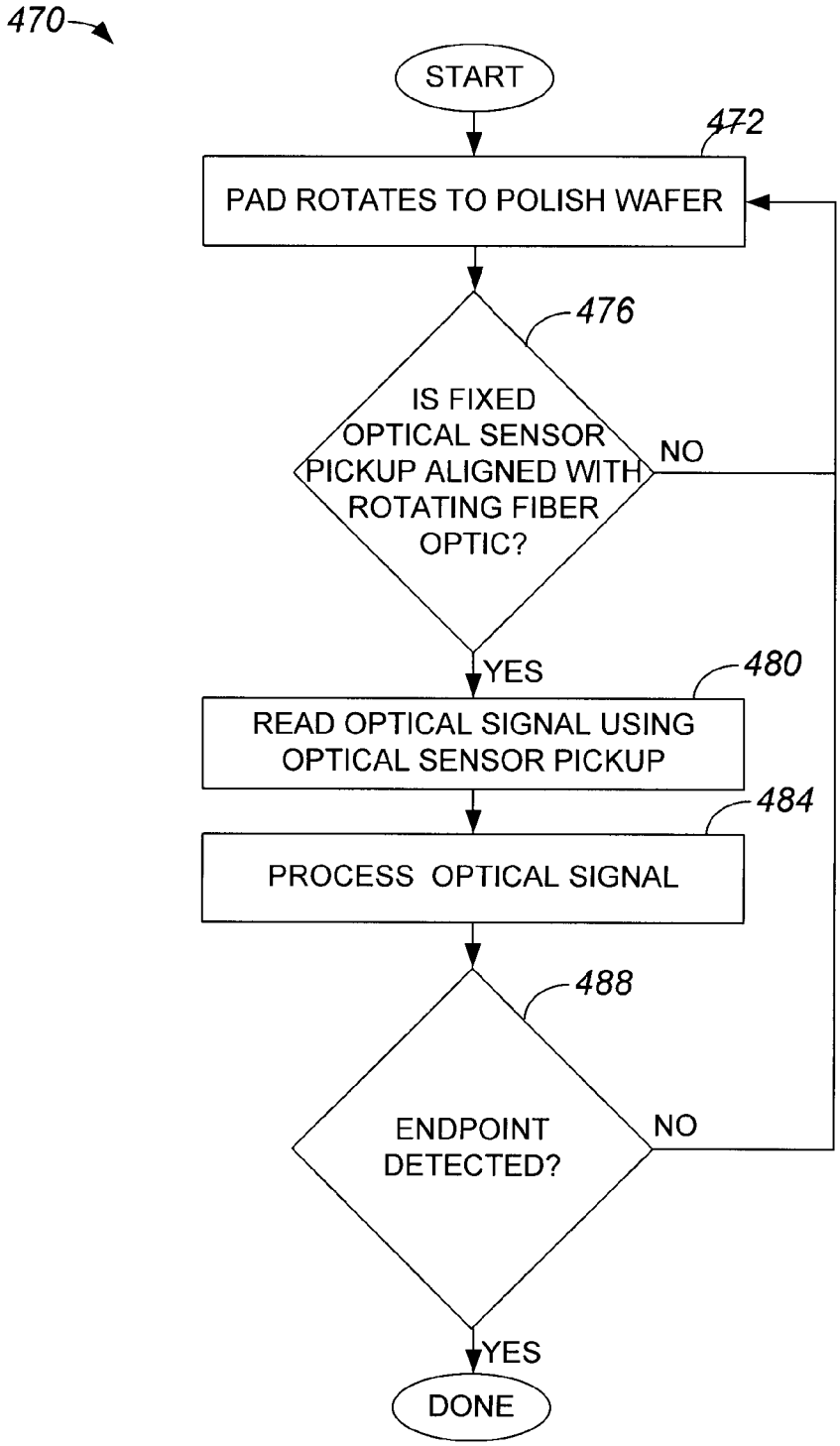
FIG. 4C is a process flow diagram which illustrates one method of detecting an endpoint in accordance with an embodiment of the present invention.

With reference to FIG. 4C, one method of utilizing a CMP apparatus with an optical fiber path that includes an endpoint detector embedded in an annulus of a polishing pad arrangement will be described in accordance with an embodiment of the present invention. A process 470 of detecting an endpoint begins at step 472 in which a polishing pad rotates to polish a wafer. In general, the polishing pad applies a force to the surface of the wafer that is being polished, and a slurry provides particles that allow the surface of the wafer to be abraded.

A determination is made in step 472 regarding whether a fixed optical sensor pickup is aligned with a rotating fiberoptic such that the fixed optical sensor pickup is in a measuring mode. In other words, it is determined whether the positioning of the rotating fiberoptic relative to a fixed optical sensor pickup is such that data acquisition may occur. It should be appreciated that such a determination may be made periodically, or may entail a substantially automatic determination that is made in response to an interrupt that is generated whenever the rotating fiberoptic is aligned with the fixed optical sensor.

If the determination in step 476 is that the fixed optical sensor pickup is not aligned with the rotating fiberoptic, i.e., that the fixed optical sensor pickup is in a non-measuring mode, then process flow returns to step 472 in which the pad continues to rotate. It should be appreciated that the fixed optical sensor pickup, or a measuring device, typically cycles between a measuring mode and a non-measuring mode such that the fixed optical sensor pickup periodically performs data acquisition Alternatively, if the determination in step 476 is that the fixed optical sensor pickup is aligned with the rotating fiberoptic, the implication is that data acquisition may occur. Accordingly, in step 480, the fixed optical sensor pickup detects or reads a reflected optical signal, i.e., an optical signal that is reflected off of a surface of the wafer through the rotating fiberoptic. The optical signal that is read by the fixed optical sensor pickup is then processed in step 484. Processing the signal using a fixed optical sensor pickup, or a computing system that is in communication with the fixed optical sensor pickup, may include using the endpoint detector sensor to determine a depth associated with the polished surface of the wafer, e.g., a top layer of the wafer. Such a depth may be used to determine whether an endpoint has been detected. In one embodiment, multiple consecutive optical signals may be stored and then substantially averaged during processing.

Once the optical signal is processed, it is determined in step 488 if an endpoint has been detected. Determining if an endpoint has been detected may generally include determining when critical dimensions have been reached with respect to the wafer, or determining when a desired film or layer thickness on the wafer has been achieved. If it is determined that an endpoint has not been detected, the pad continues to rotate such that the wafer is polished in step 472. Alternatively, if it is determined that an endpoint has been detected, then the polishing process is effectively completed.

The use of a segmented optical fiber path allows for a substantially direct endpoint measurement to be performed on a wafer in real time. Further, a segmented optical fiber path effectively allows measurements to be made over substantially the entire surface of a wafer that is undergoing CMP. Since the fiberoptic is within the annulus of the polishing pad, the fiberoptic will substantially always remain within the diameter of the wafer, as the center region of the polishing pad dispenses slurry. It should be appreciated that if the center region of the polishing pad transits off the wafer edge slurry would spill out and would not flow between the top surface of the wafer and the polishing pad. By adding a mirror arrangement substantially within a polishing head assembly, the ability to record an endpoint signal even when a rotating fiberoptic is not substantially directly aligned with a fixed optical sensor pickup may be provided. Through the use of a mirror arrangement, a fixed optical sensor pickup may detect reflected internal light even when the rotating fiberoptic is not substantially directly aligned with the fixed optical sensor pickup. Software algorithms may be used in conjunction with the mirror arrangement to allow the fixed optical sensor pickup to substantially continuously perform data acquisition from the surface of a wafer.

Figure 5A:
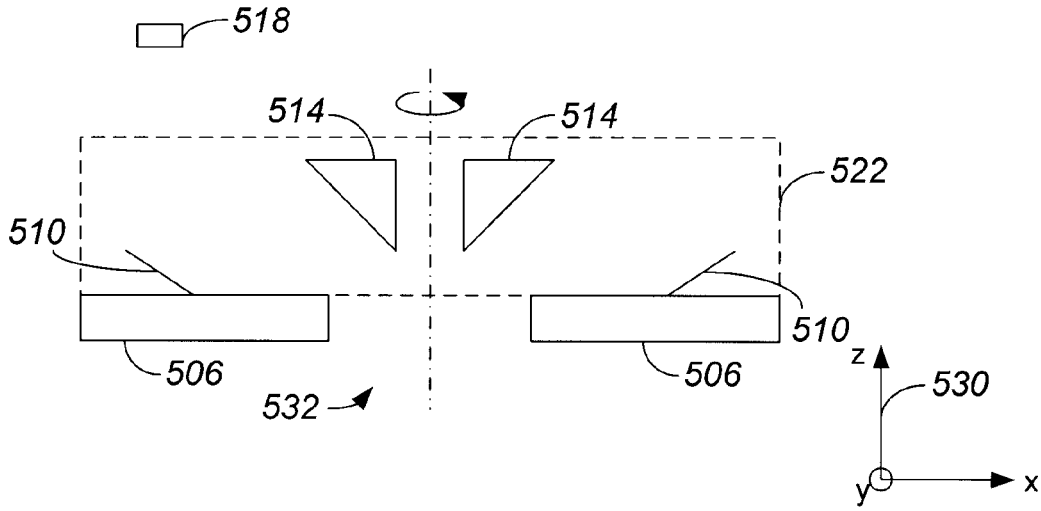
FIG. 5A is a diagrammatic cross-sectional side-view representation of a mirror arrangement in accordance with an embodiment of the present invention.

In one embodiment, a mirror arrangement that facilitates the substantially continuous acquisition of data to allow an endpoint to be detected includes a conical mirror and a concave mirror that may be positioned within a support or pad plate of a polishing head. FIG. 5A is a diagrammatic cross-sectional side-view representation of a mirror arrangement in accordance with an embodiment of the present invention. A pad plate 522 which supports a polishing pad arrangement 506 is arranged to contain a plurality of mirrors 510, 514. A first mirror 510 is effectively a ring-shaped mirror with substantially concave surface, while a second mirror 514 is effectively a conically-shaped mirror.

Figure 5B:
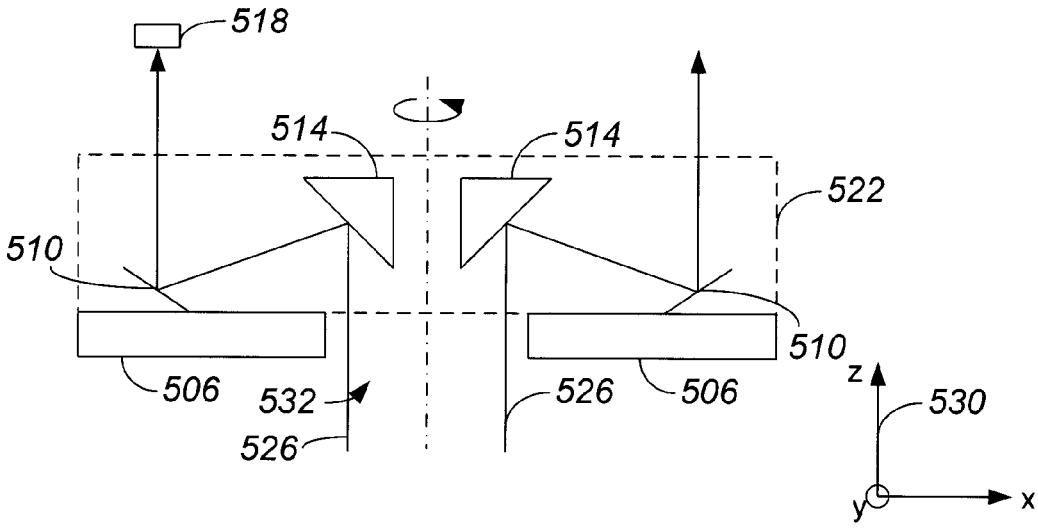
FIG. 5B is a diagrammatic cross-sectional side-view representation of a mirror arrangement, i.e., the mirror arrangement of FIG. 5A that includes mirrors 510 and 514, which shows reflected light waves in accordance with an embodiment of the present invention.

An opening 532 in polishing pad arrangement 506 may be an opening associated with a rotating fiberoptic embedded or otherwise positioned within an annulus of polishing pad arrangement 506. As shown in FIG. 5B, when light 526 is reflected off of a surface (not shown) below polishing pad arrangement 506, e.g., off of a surface of a wafer, light 526 the reflects off of conical mirror 514 and onto concave mirror 510. From concave mirror 510, light 526 may be provided to a fixed optical sensor pickup 518 or, more generally, a measuring device. The portion of concave mirror 510 from which fixed optical sensor pickup 518 receives light 526 depends upon the location of a rotating fiberoptic (not shown), although fixed optical sensor pickup 518 substantially continuously receives light 526. As fixed optical sensor pickup 518 substantially continuously receives light 526, fixed optical sensor pickup 518 is effectively in a continuous measuring mode during polishing. It should be appreciated, however, that reflected light 526 is effectively reflected into a single point. The amount of power provided to allow light 526 to be reflected off of the surface of a wafer (not shown) and back to fixed optical sensor pickup 518 is typically at least enough to allow light 526 to be effectively received by fixed optical sensor pickup 518 regardless of where on concave mirror 510 light 526 is reflected off from.

In lieu of using a mirror arrangement to allow the surface of a wafer to be substantially continuously monitored to identify an endpoint, an annular fiberoptic may be used. An annular fiberoptic may be positioned between a rotating fiberoptic and a fixed optical sensor pickup in order to reduce the distance over which light is sent. In other words, an annular fiberoptic may enable the distance traveled by light within a polishing head to be reduced. An annular fiberoptic may enable the rotating fiberoptic to be substantially "lined up" with the annular fiberoptic such that reflected light may be detected regardless of the actual location of the rotating fiberoptic. The annulus of the fiberoptic distributes it fibers around the entire ring, so at least one fiber is substantially always aligned with the optical sensor. When an annular fiberoptic is used, a light source such as a white light light-emitting diode (LED) may be positioned to substantially illuminate a wafer surface through an annulus of a polishing pad such that endpoint detection may occur. Placement of the LED at the bottom of the fibers in the annulur fiberoptic, and in relatively close proximity to the surface of the wafer, results in an increase of the signal-to-noise ratio associated with end point detection and, hence, allows for better analyses to be performed.

Figure 6:
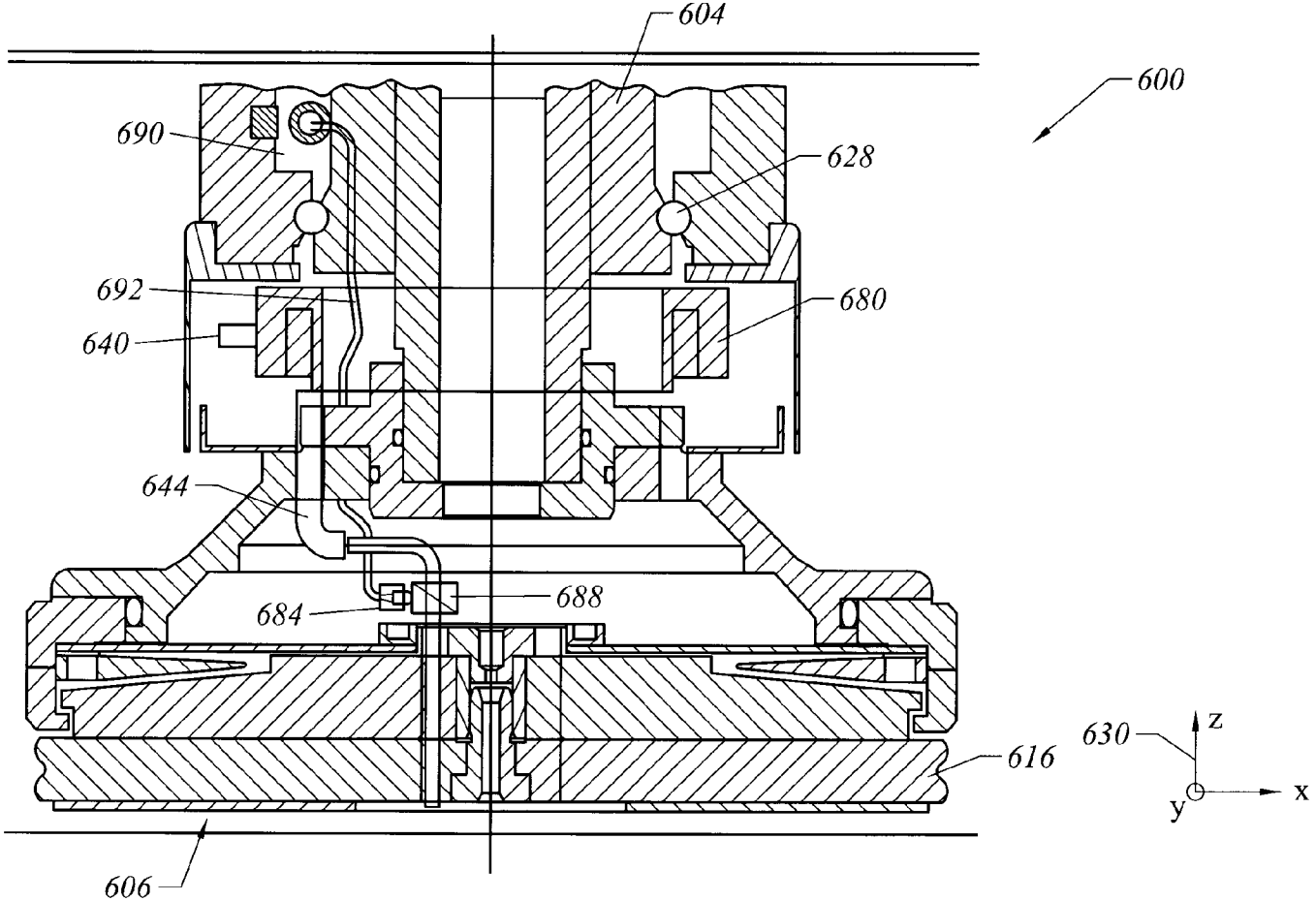
FIG. 6 is a diagrammatic cross-sectional side-view representation of a portion of a CMP apparatus that includes an annular fiberoptic in accordance with an embodiment of the present invention.

FIG. 6 is a diagrammatic cross-sectional side-view representation of a portion of a CMP apparatus that includes an annular fiberoptic in accordance with an embodiment of the present invention. A CMP apparatus 600 includes a polishing head 604 which is similar to polishing head 304 of FIG. 3A. A polishing pad arrangement 606 is supported on a pad plate 616, and rotates about a z-direction 630 when polishing head 604 rotates relative to CMP apparatus 600, as facilitated by a bearing 628.

An annular fiberoptic ring 680 is positioned between an endpoint detection sensor 640 and a first rotating fiberoptic arrangement 644. The output of endpoint detection sensor 640 and the overall segmented fiberoptic path that includes fiberoptic arrangement 644 and annular fiberoptic ring 680 may be provided to an external apparatus via a radio frequency transmitter (not shown). That is, data acquired relating to endpoint detection may be provided to a computing system or other device effectively from polishing head 604 via a radio frequency transmitter.

An LED 684, which may be a white light LED with a constant current source integrated circuit, is arranged to illuminate a wafer surface (not shown) such that the light produced by LED 684 may be reflected back to annular fiberoptic ring 680. In one embodiment, beam splitter optics 688 substantially separate optical paths for providing light and for receiving light. Optics associated with LED 684 may be substantially embedded in polishing pad 606, e.g., fiberoptic cables that carry light from LED 684 are typically embedded in an annulus of polishing pad arrangement 606. To provide power to LED 684, a generator coil and magnet arrangement 690 may be used. Coil and magnet arrangement 690 is typically coupled to LED 684 by a lead wire 692 such that current ay be provided to LED 684.

Figure 7:
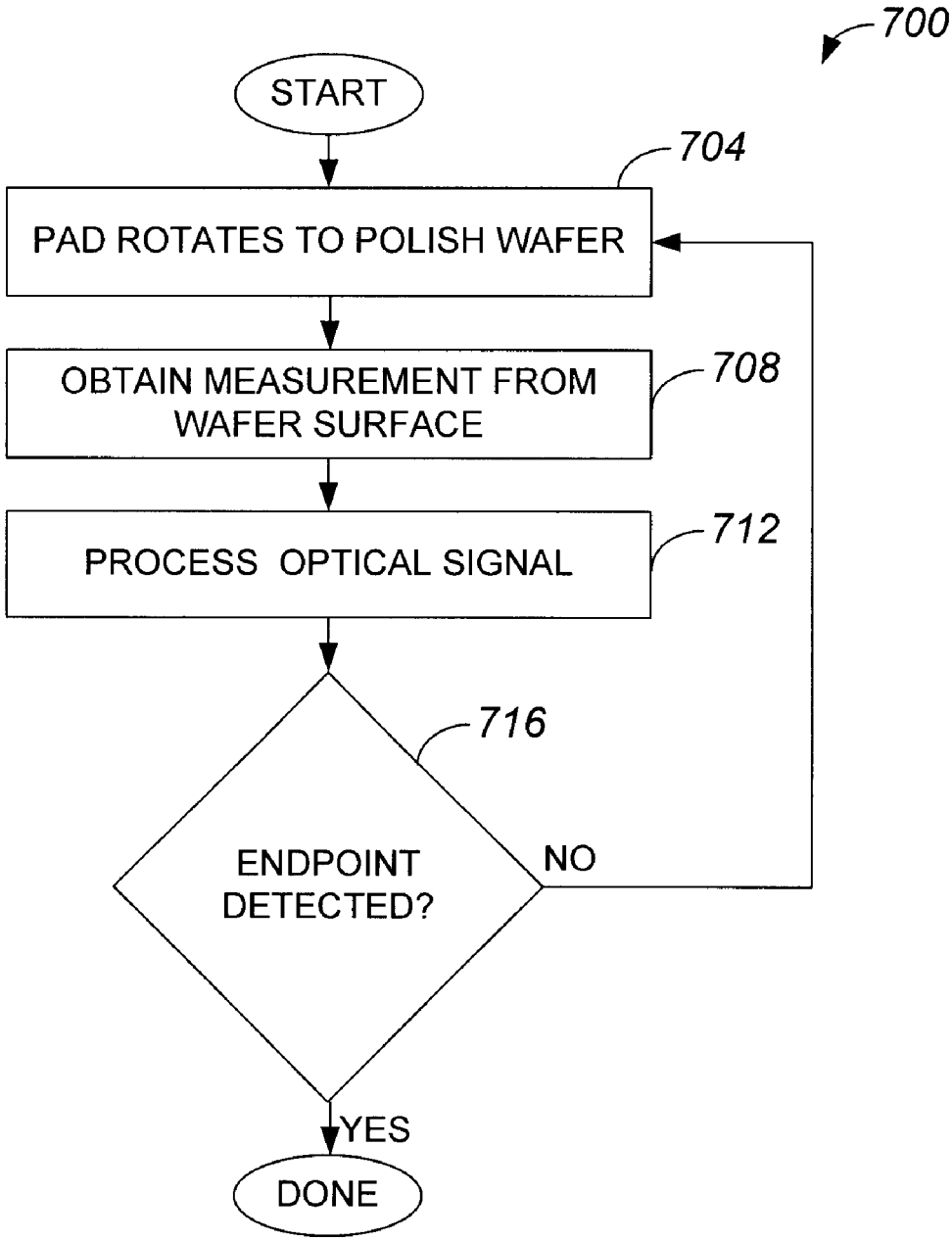
FIG. 7 is a process flow diagram which illustrates one method of using either a mirror arrangement or an annular fiberoptic to detect an endpoint associated with a CMP process in accordance with an embodiment of the present invention.
Figure 8:
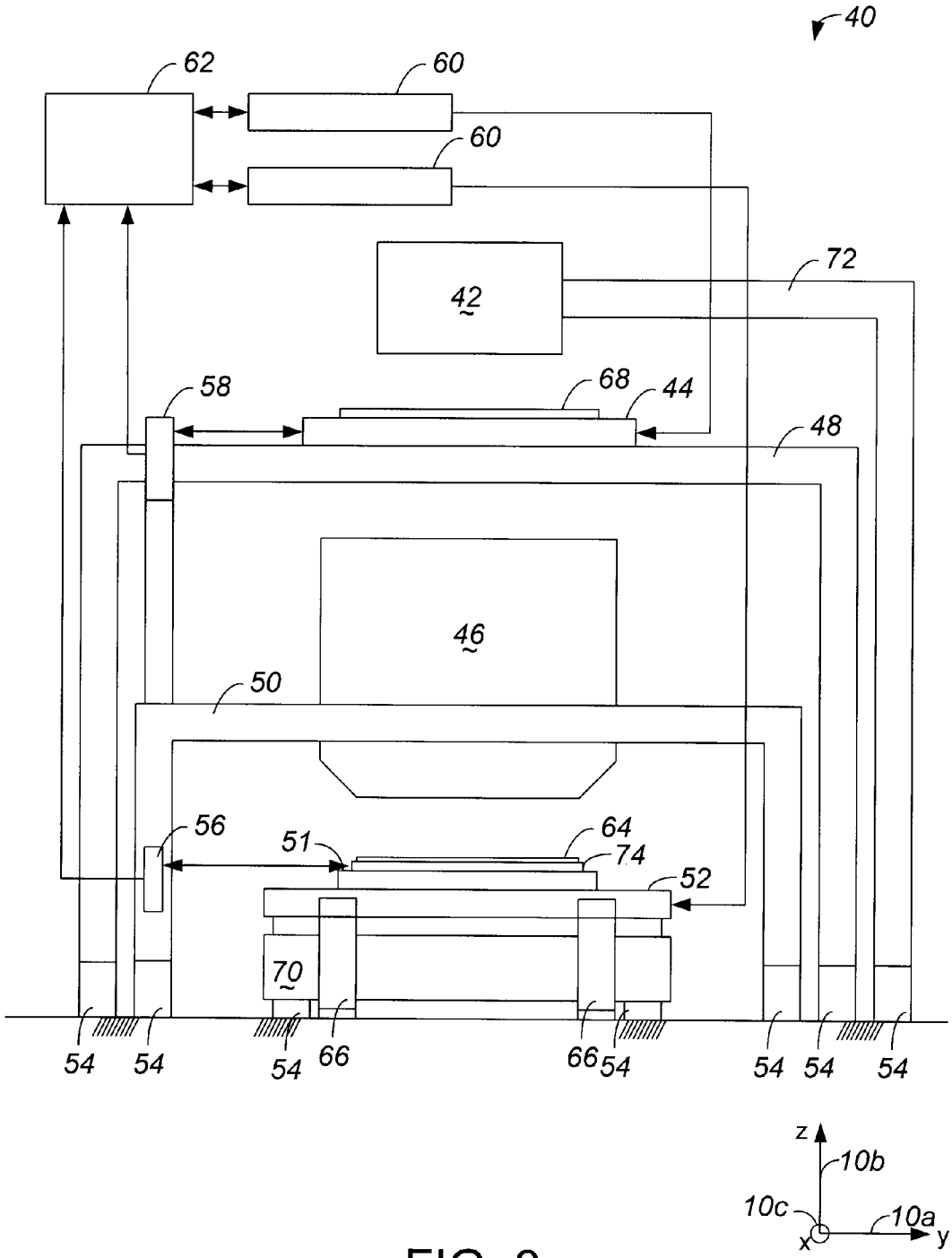
Figure 9:
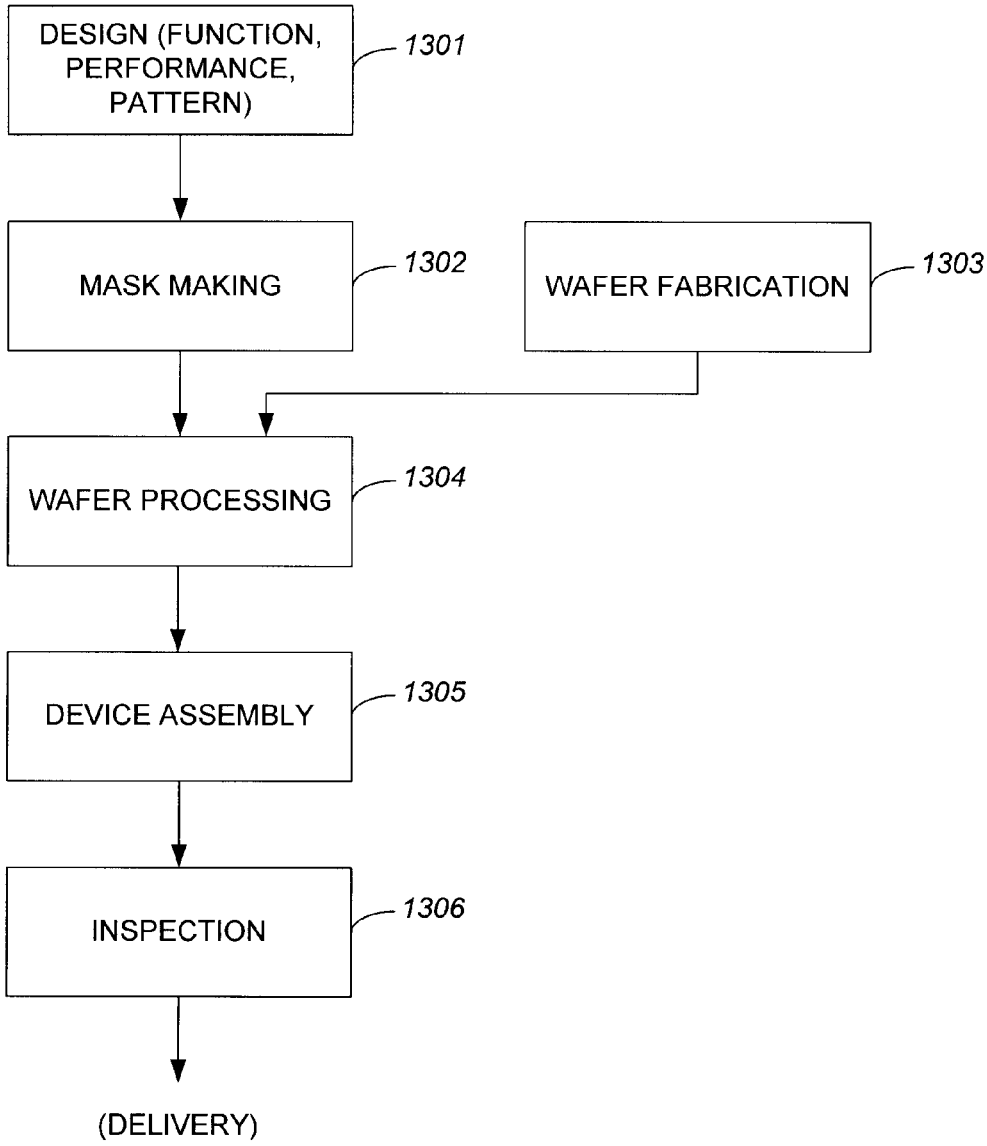
Figure 10:
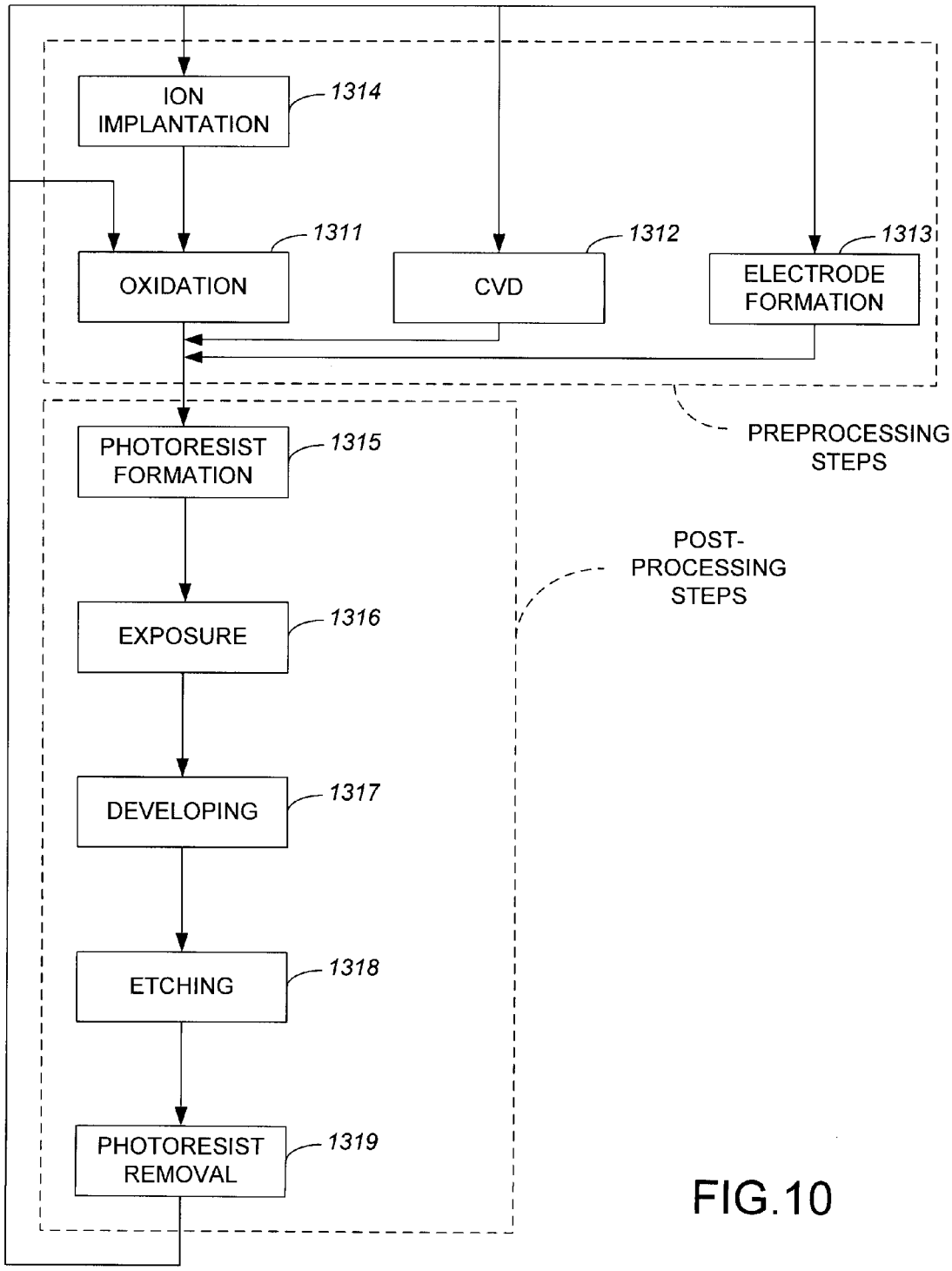

When either a mirror arrangement or an annular fiberoptic are used as a part of a fiberoptic path with a rotating fiberoptic sensor, e.g., a substantially segmented fiberoptic path, measurements from the surface of a wafer being polished may be obtained substantially continuously. FIG. 7 is a process flow diagram which illustrates one method of using either a mirror arrangement or an annular fiberoptic to detect an endpoint associated with a CMP process in accordance with an embodiment of the present invention. A process 700 of identifying an endpoint begins at step 704 in which a polishing pad rotates to polish a surface of a wafer. Substantially while the wafer is being polished, a measurement from a wafer surface is obtained in step 708. The measurement, in one embodiment, may be obtained when a white LED illuminates the wafer surface and reflected light is transmitted through a rotating fiberoptic to an annular fiberoptic. Such a measurement may be substantially continuously obtained, i.e., reflected light is substantially continuously transmitted through the rotating fiberoptic while the wafer is being polished.

Once a measurement is obtained from the wafer surface, the optical signal that effectively contains the measurement is processed in step 712. Processing the optical signal may involve transmitting the optical signal to a control system or a computing system, e.g., using a radio frequency transmitter, that determines whether the measurement indicates that an endpoint has been detected. It should be appreciated that an average of measurements obtained from the wafer surface may be used to determine whether an endpoint has been reached. That is, a control system or a computing system is capable of substantially averaging multiple measurements.

It is determined in step 716 whether an endpoint has been detected. If it is determined that an endpoint has not been detected, then process flow returns to step 704 in which the polishing pad continues to rotate to polish the wafer surface. Alternatively, if it is determined that an endpoint has been detected, the implication is that the CMP process should be terminated. Accordingly, the process of identifying an endpoint is completed. As will be appreciated by those skilled in the art, once an endpoint is identified, the wafer typically no longer needs to be polished, i.e., the polishing pad no longer needs to rotate to polish the wafer surface.

Although only a few embodiments of the present invention have been described, it should be understood that the present invention may be embodied in many other specific forms without departing from the spirit or the scope of the present invention. By way of example, fiberoptics have generally been described as being substantially embedded in an annulus of a polishing pad. However, the fiberoptics may instead be embedded in other areas of a polishing pad.

A fiberoptic embedded in a polishing pad may be arranged to come into direct contact with the surface of a wafer that is being polished. Alternatively, the fiberoptic embedded in a polishing pad may be arranged to be slightly recessed with respect to a surface of the polishing pad that comes into contact with the surface of a wafer. That is, a rotating endpoint detector embedded in a polishing pad may be arranged to be positioned in close proximity to the surface of a wafer but not in actual direct contact with the surface of the wafer.

The parameters associated with a CMP apparatus may vary widely. For instance, the speed at which a rotating endpoint detector moves may vary, although in one embodiment, the speed may be approximately 300 revolutions per minute. Further, the distance that typically separates a rotating endpoint detector and a slurry feedthrough in an annulus of a polishing pad arrangement. Such a distance may vary widely. By way of example such a distance may be approximately 17.36 mm or greater.

A fixed optical pickup or a measuring device may be substantially any suitable measuring device that is capable of continuously measuring a polishing surface of a wafer during polishing. While a measuring device may be a fiberoptic device, a capacitance sensor, or an eddy current measuring device, it should be understood that the configuration of a measuring device may vary widely.

The present invention has been described in terms of a single measuring device being used to measure a polishing surface of a wafer during polishing. In lieu of a single measuring device, multiple measuring devices may be incorporated into a polishing pad arrangement to measure the surface of a wafer. The use of more than one measuring device may allow different locations on the surface of a wafer to be measured, e.g., at approximately the same time, during a polishing process. Taking an average of the measurements made at different locations substantially simultaneously may allow for a more accurate determination of an overall polishing depth. That is, taking measurements at different locations substantially simultaneously during polishing may enable a more accurate identification of an endpoint associated with a CMP process.

In general, the steps associated with the various methods of the present invention may vary widely. Steps may be added, removed, reordered, and altered without departing from the spirit or the scope of the present invention. Therefore, the present examples are to be considered as illustrative and not restrictive, and the invention is not to be limited to the details given herein, but may be modified within the scope of the appended claims.

The invention claimed is:

1. A method of identifying an endpoint of a chemical mechanical polishing (CMP) process performed on a polishing surface, the method comprising:

polishing the polishing surface using a polishing pad assembly, the polishing pad assembly being arranged to contact the polishing surface;

providing an optical signal through an optical signal path arrangement, the optical signal path arrangement including a fixed portion and a moving portion, wherein the moving portion is arranged to be at least partially contained by an annulus of the polishing pad assembly, the polishing surface being arranged to reflect the optical signal, and wherein the optical signal is provided by a light emitting diode (LED) through a first path of the optical signal path arrangement;

receiving the reflected optical signal through the optical signal path arrangement when the fixed portion and the moving portion are aligned to allow the reflected optical signal to pass through the moving portion to the fixed portion, wherein the reflected optical signal is received by an annular fiberoptic ring of the fixed portion through a second path of the optical signal path; and processing the reflected optical signal to determine if the endpoint has been reached, wherein processing the reflected optical signal includes determining a depth associated with the polishing surface.

2. The method of claim 1 wherein the reflected optical signal provides substantially continuous measurements of the depth associated with the polishing surface.

* * * * *